US007419130B2

(12) United States Patent
Peery

(10) Patent No.: US 7,419,130 B2
(45) Date of Patent: Sep. 2, 2008

(54) RUSTICATION FOR ARCHITECTURAL MOLDING

(75) Inventor: Michael Peery, City of Industry, CA (US)

(73) Assignee: Peery Bros. Lumber Co. Inc., City of Industry, CA (US)

( * ) Notice: Subject to any disclaimer, the term of this patent is extended or adjusted under 35 U.S.C. 154(b) by 61 days.

(21) Appl. No.: 11/433,361

(22) Filed: May 15, 2006

(65) Prior Publication Data

US 2007/0262227 A1 Nov. 15, 2007

(51) Int. Cl.
*B28B 7/00* (2006.01)

(52) U.S. Cl. ..... 249/35; 249/112; 249/134; 249/175; 249/177

(58) Field of Classification Search ..... 249/35, 249/134, 177, 187.1, 189, 205, 175, 112
See application file for complete search history.

(56) References Cited

U.S. PATENT DOCUMENTS 2,021,210 A * 11/1935 Thorn ..... 249/1
3,148,433 A * 9/1964 Carriker ..... 249/176
3,632,078 A * 1/1972 Dashew ..... 249/183
4,042,728 A 8/1977 Chiu et al.
4,243,200 A * 1/1981 Beer et al. ..... 249/187.1
5,074,517 A * 12/1991 Scott ..... 249/112
5,397,096 A * 3/1995 Nelson ..... 249/31
5,397,524 A * 3/1995 Phillips ..... 264/145
5,855,808 A * 1/1999 DiBerardino ..... 249/114.1
D428,162 S * 7/2000 Eyring et al. ..... D25/121
6,082,074 A * 7/2000 Shaw et al. ..... 52/742.14
6,279,868 B1 * 8/2001 Eyring et al. ..... 249/177
6,358,575 B1 * 3/2002 Spragg ..... 428/34.1
6,398,180 B1 * 6/2002 Eyring et al. ..... 249/177
6,736,366 B2 * 5/2004 Eyring et al. ..... 249/177
6,749,171 B2 6/2004 Takagi
6,827,322 B2 * 12/2004 Martinez et al. ..... 249/63
6,840,018 B2 * 1/2005 Takagi ..... 52/600
7,000,886 B2 2/2006 Greif et al.
2006/0249874 A1 * 11/2006 Takagi ..... 264/236

FOREIGN PATENT DOCUMENTS

JP 06010467 A * 1/1994

* cited by examiner

*Primary Examiner*—Philip C Tucker
*Assistant Examiner*—Dimple N Bodawala
(74) *Attorney, Agent, or Firm*—John J. Yim, Esq.

(57) ABSTRACT

The present invention concerns rustication forms or moldings having covering (overlay or wrapping) that alleviate problems associated with concrete slab curing. The present invention also concerns methods for forming rustication in concrete walls. The present invention comprises a rustication form substrate, wherein all or portions of the surface exposed to the curing concrete is covered with covering or layering, and only portions of surfaces not exposed to the curing concrete is covered.

16 Claims, 4 Drawing Sheets

RUSTICATION FOR ARCHITECTURAL MOLDING

BACKGROUND OF INVENTION

The present invention generally concerns rustication forms and molding and methods of forming rustication and moldings. More specifically, the present invention concerns rustication forms for use in concrete slab formation for forming rustication and molding impressions in concrete wall slabs.

Molding or rustication forms are used in the construction industry for creating architectural moldings and elements in concrete slab formation. Building walls in constructions projects, whether residential or commercial, often use concrete slab, tilt-up walls. Such concrete walls are generally formed at the construction site during building construction.

Generally, construction crews form concrete slabs for use as tilt-up walls by first preparing a flat even surface. Leveled concrete slabs, anchored by the foundations, are often used as the formation surface for making such concrete slabs. Alternatively, a thin formation surface or slab can be poured on ground for forming such walls and concrete slabs. The formation surface is then prepared by positioning enclosure or retaining walls for forming the outer walls of such slabs and walls. Once the formation surface and the position or retaining walls are prepared, wet concrete is poured into the area formed by such enclosure walls and allowed to cure. When the concrete dries and cures, the cured concrete slab is generally tilted up for use. The present invention, however, is not limited to concrete slab walls. The present invention can be applied as known in the art to any molding or rustication formation using curable construction material and rustication or molding forms. In examples discussed below, however, the example of the concrete slab wall will be referenced.

Rustication is generally the molding or architectural formation left on the concrete walls. Rustication can be made by cutting or shaping masonry or concrete so as to create molding, architectural elements, and to otherwise shape the surface of such masonry or concrete formations.

In the construction industry, rustications are often used for design elements. For example, a variety of rustication forms, which are substrates that serve as the physical molds for forming such rustications, are used to create architectural design impressions and formations into the curing concrete walls. They are also used for functional purposes as known in the art. For example, a rustication form can be laid to create a molding or impression or shape the curing concrete for forming a functional wall ledge impression.

NEED IN THE ART

In forming such rustications, smooth and clean surfaced rustications are desired. Difficulties, however, arise from characteristics of concrete curing and formation. Because concrete is wet as it is poured, it takes time to settle, dry and cure. During the curing process, water in the concrete may seep into the rustication or molding forms. Depending on the characteristics of the rustication substrate, the final rustication form may not cure as desired.

For example, if the surface of the rustication form is porous or semi-porous, water may seep into the rustication form and cause it to swell, bloat, distort or cause other water damage. The resulting rustication in the dried concrete may have uneven, rough or otherwise unfinished look and/or form. In some instances, water seeping into the rustication form substrate may cause dusting, wherein the surface of the concrete formation has a dusty appearance due to the uneven curing of the concrete particles as water trickles into the substrate. Such imperfections on the concrete surface will require additional construction labor, material, handling and time, resulting in delay, increased costs and inconvenience.

Furthermore, as water penetrates the rustication substrate, concrete may also adhere to and stick to rustication forms. As the dried concrete wall is lifted up, rustication forms may come up with the wall. Additional time would then be required to separate the rustication forms from elevated concrete walls. Further, as rustication forms are removed, surface of rustication left on concrete wall may be damaged, requiring additional cost, labor and delay.

Additionally, rustication forms used in construction projects are often custom ordered and require short lead times from order to production. Special sizes may depend on architectural needs, and custom orders are often routine. There is a need for quick manufacture and a quick turnaround time. There is a need for a readily manufacturable product and a quick manufacturing process addressing the needs discussed.

Furthermore, in construction projects, rustication forms are preferably discarded after single use. Although there may be examples of reusable rustication forms, because of the needs for customized rustication forms based on individual building, architectural and design needs, inexpensive single-use rustication forms are needed.

Prior art rustications have used specialized materials or have used paint-style applied coatings. But these rustications are difficult to manufacture and consume additional costs associated with material or equipment set-up and they are more difficult to manufacture. For example, prior art rustications that use spray-on type of coating use difficult and time consuming manufacturing processes that require specialized equipment and set up. Furthermore, environmental hazards are associated with painting and spraying, requiring permitting and licensing.

Some of the preferred embodiments of the present invention are discussed below. As the present invention may be embodied in several forms without departing from the spirit or essential characteristics thereof, it should also be understood that the description contained herein is not limited by the details of the foregoing description, unless otherwise stated. The present invention should be construed within its spirit and scope, and therefore all changes and modifications that fall within the meets and bounds of the claims, or equivalences of such meets and bounds are therefore intended to be embraced by the invention.

DESCRIPTION OF INVENTION

Generally, the present invention concerns rustication forms or moldings having covering (overlay or wrapping) that alleviate problems associated with concrete slab curing. The present invention also concerns methods for forming rustication in concrete walls. More specifically, the present invention comprises the rustication form substrate, wherein all or portions of the surface exposed to the curing concrete is covered with covering or layering, but only portions of surfaces not exposed to the curing concrete is covered.

Before the concrete is poured, rustication forms are laid down on the formation surface. Rustication forms come in a variety of sizes and shapes as known in the art. Some examples include chamfers, quarter rounds, half rounds, coves, and polygons, which refer generally to the shape of the cross sectional areas of such rustication forms. Generally, a rustication form has one or more surfaces that are not exposed to the poured concrete, and one or more surfaces that are exposed to poured concrete.

Rustication forms are generally attached to the formation surface to prevent movement during concrete pouring. Rustications forms may be attached to the formation surface using, for example, glue, double sided tape, or by nailing. Since formation surfaces are generally cured concrete surfaces, nailing is not the preferred option. Thus, glue and double sided tape is preferred Once the concrete is poured to make a new concrete wall, it will be allowed to dry and cure, after which the concrete is tilted up as walls. It is desirable for the rustication forms to remain on the formation surfaces rather than sticking to the slab wall. Otherwise, the rustication forms will need to be manually removed and it may signal adhesion between the concrete wall and the rustication form.

The present invention concerns a rustication form having covering (overlay or wrapping) that alleviates problems associated with concrete slab curing comprising architectural molding substrate or rustication form having covering or layering over surfaces exposed to the curing concrete and having cover or layering over only portions of surfaces not exposed to curing concrete. In an alternative embodiment, the present invention comprises rustication for having covering or layering over portions of surfaces exposed to the curing concrete and having covering or layering over portions of surfaces not exposed to the curing concrete.

Some architectural molding substrates (rustication form) have rough surfaces or water absorptive surfaces. Substrates can be one or more of any rigid material such as lumber, plywood, MDF or medium density fiberboard, HDF or high density fiberboard, OSB or oriented strand board, foam, particle board, wheat board, sheet rock, dry wall, or other substrates as known in the art.

Figure 1:
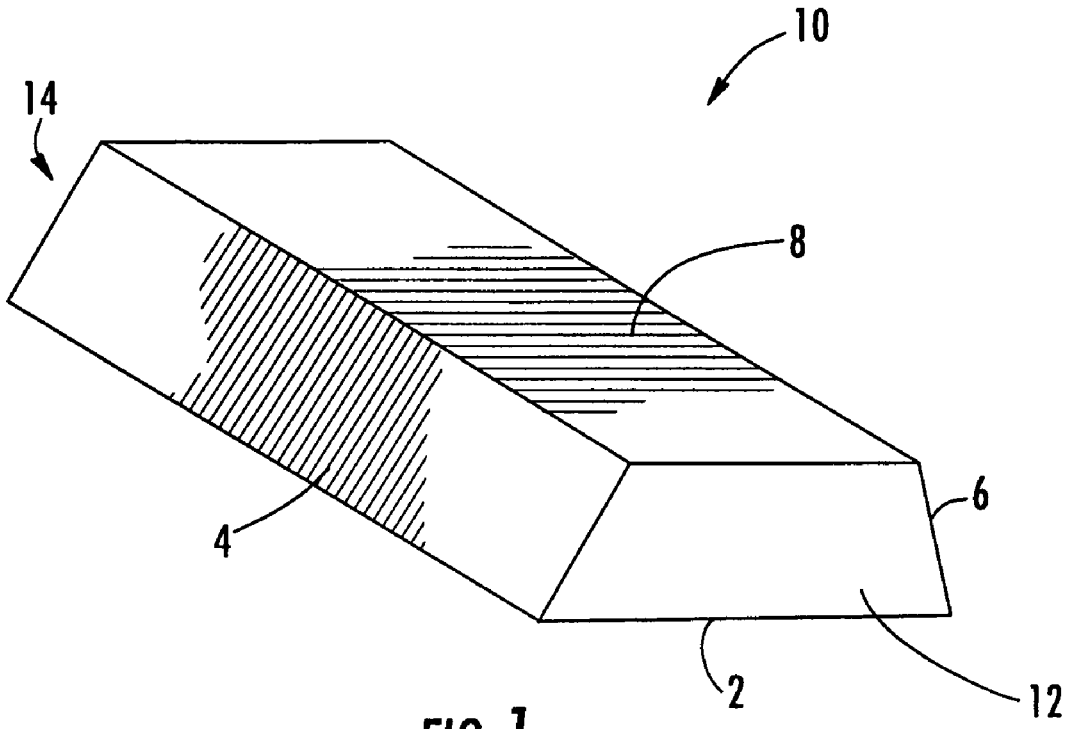
FIG. 1 shows a three-dimensional view of a rustication form or substrate having a polygonal (four-sided) cross-sectional area.
Figure 2:
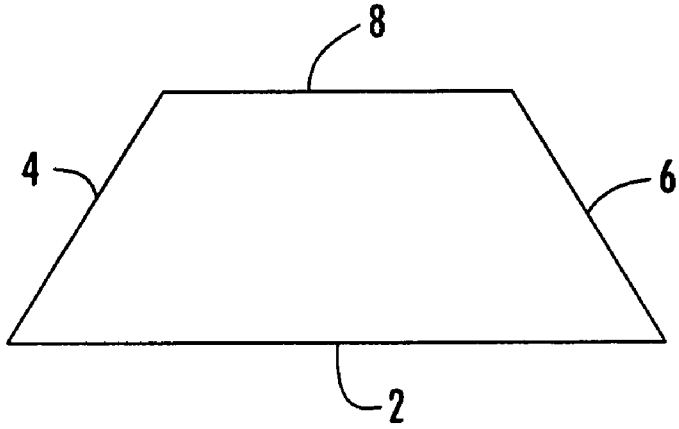
FIG. 2 shows the cross sectional view of the rustication substrate of FIG. 1.

Size and shape can vary as known in the art. They may also be flat or have surface shapes as may be required for the project at hand. Referring to FIG. 1, a rustication substrate or the architectural molding substrate 10 is shown. The rustication substrate 10 shown in FIG. 1 has a four-sided, polygonal, cross sectional area as seen in FIG. 2. The rustication substrate 10 of FIG. 1 has a wider bottom surface 2 than the top surface 8. The rustication substrate 10 also has two side surfaces 4 and 6. Generally, the rustication form 10 would be placed onto a formation surface (not pictured) so that the bottom surface 2 would be resting on and be in direct contact with the formation surface. The front surface 12 and back surface 14 may rest against retaining walls (not pictured) for containing the poured concrete. In alternative embodiments, the front surface 12 and/or the back surface 14 may also be angled as in the side surfaces.

As can be seen in FIGS. 1 and 2, three surfaces would then be exposed to the curing concrete. The top surface 8 and the two side surfaces 4 and 6 would all be exposed to and would be in direct contact with the curing concrete poured over the rustication form 10. As discussed, water from the wet concrete will be in direct contact with the exposed surfaces 4, 6 and 8. But the bottom surface 2, which is in contact with the formation surface, is not substantially in contact with the curing concrete.

Figure 3:
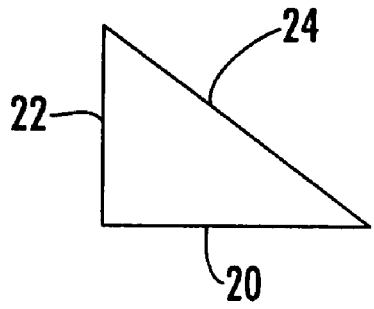
FIG. 3 shows a cross sectional view of a rustication substrate, wherein the cross sectional area has three sides.
Figure 4:
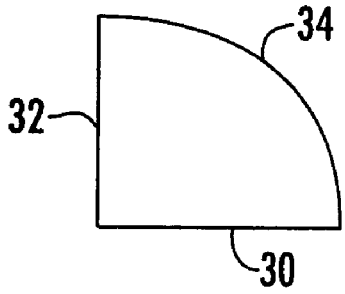
FIG. 4 shows a cross sectional view of a rustication substrate, wherein the cross sectional area is a quarter circle.
Figure 5:
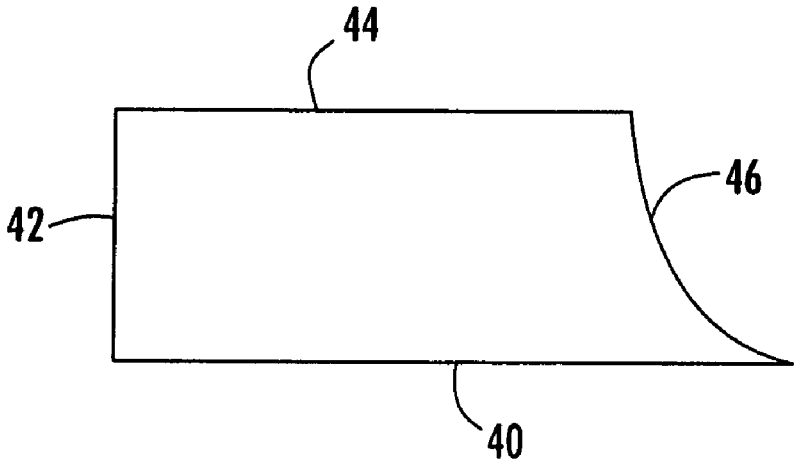
FIG. 5 shows a cross sectional view of a rustication substrate, wherein the cross sectional area has four sides with one of the sides being curved.

FIGS. 3-5 show examples of cross-sectional views of varying shaped rustication forms. FIG. 3 shows a rustication form having three sides 20, 22 and 24. The bottom unexposed surface 20 and the side unexposed surface 22 are not substantially in contact with the concrete, assuming that the side unexposed surface 22 is in contact with a retaining wall (not pictured) for the poured concrete. Because the concrete is wet and the surfaces are in substantial contact, there is often some exposure to water even on the unexposed surfaces, through seepage. In other embodiments, surface 22 may be exposed to curing concrete if it is not in contact with a retaining wall. The diagonal exposed surface 24, however, would be exposed to the curing concrete in the example above where the side unexposed surface 22 is resting against a retaining wall.

Similarly, in FIG. 4, the bottom unexposed surface 30 is not exposed to the curing concrete as it rests on the formation surface. Again, if the side unexposed surface 32 is abutting a retaining wall, it will also not substantially be exposed to the curing concrete. The curved exposed surface 34 would then be exposed to the curing concrete. Also in FIG. 5, examples of varying shapes are seen in this cross-sectional view of a rustication form having a side unexposed surface 42 (if abutting a retaining wall), a top exposed surface 44, curved exposed surface 46, and bottom unexposed surface 40.

Figure 6:
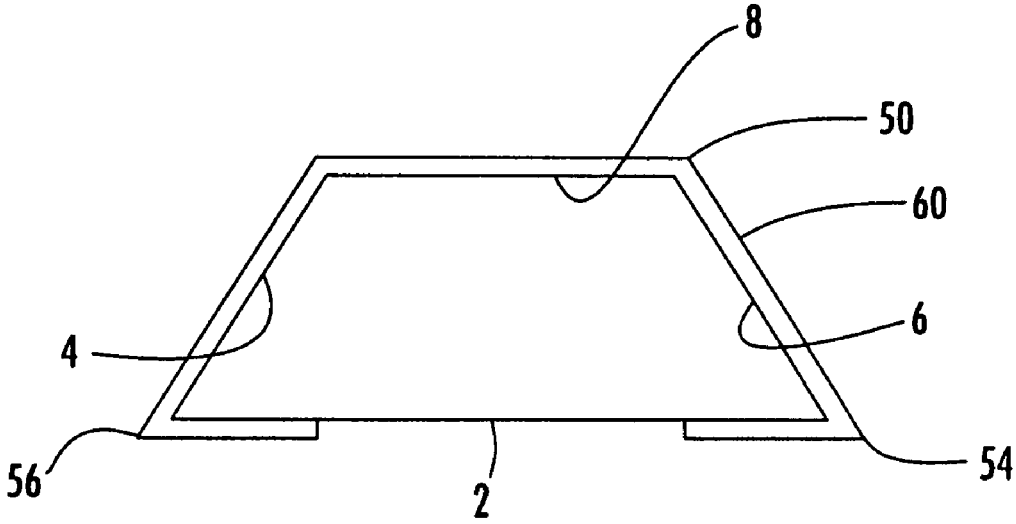
FIG. 6 shows a cross sectional view of a rustication substrate having four sides with covering over all of three surfaces and over portions of the bottom surface.

The rustication form of the present invention further comprises a wrapping, covering or overlay. FIG. 6 shows an embodiment of the present invention wherein the cross-sectional view of the rustication form, comprising bottom surface 2, side surfaces 4 and 6 and top surface 8, further comprise a covering, wrapping or overlay 60, that covers all of the top surface 8 and all of the side surfaces 4 and 6 and only portions of the bottom surface 2.

The covering 60 can be made of variety of paper-backed or other coated paper material. The covering 60 can also be made of plastic, vinyl or other sheeting material as known in the art. Although the covering 60 is preferably water-resistant or water proof, the present invention contemplates embodiments that may not necessarily be water proof or water-resistant, as in the case of using paper-backed or other coated paper material. But generally, the covering 60 preferably has a continuous and smooth surface as opposed to uneven or rough surfaces. The covering 60 also preferably is of material and construction that does not disintegrate and substantially maintains its form without rupturing when wet concrete is poured over it.

Thus, the wrapping or covering 60 can be water-porous, but it will preferably have relatively smooth and continuous surface. The covering 60 also preferably has structural integrity to not break down substantially while the wet concrete cures.

This will also prevent the curing concrete from dusting. Thus, as an example, although the covering 60 may be substantially be made of water-porous material such as paper based products, it can not be substantially devoid of structural integrity, such as toilet paper or paper towel, which would break down when in contact with wet concrete. The covering 60 preferably has sufficient structural integrity to allow for the concrete surface to set correctly.

The covering is preferably made of inexpensive material, suitable for single-use rustication forms. As known in the art, glue or adhesive is used for attaching the rustication substrate to the covering 60. Laminating or covering processes and machines as known in the art may be used.

As seen in FIG. 6, the covering, wrapping, laminate or outer layer 60 covers all the surfaces 4, 6 and 8 exposed to the curing concrete. However, the bottom surface 2, which is not substantially exposed to the curing concrete, is only partially covered by the covering 60. Thus, in this embodiment of the present invention, the covering 60 covers all of the one or more surfaces exposed to the curing concrete, while only partially covering one or more surface(s) not exposed to curing concrete.

Referring to the example in FIG. 3, if side 22 is not substantially exposed to the curing concrete by being positioned against a retaining wall, the side unexposed wall 22 would only partially be covered by the covering (not shown). The diagonal exposed surface 24, however, would be completely covered by the covering. The bottom unexposed surface 20 would also be only partially covered. Both the side unexposed surface 22 and the bottom unexposed surface 20 would be covered around and near the edge where these surfaces meet the diagonal exposed surface. Referring back to FIG. 6, the covering 60 makes a continuous layer of cover over the surfaces 4, 6 and 8 facing the curing concrete.

Referring back to FIG. 6, portions of the bottom surface 2, near the bottom edges 54 and 56 are also covered with covering 50. But the entire bottom surface 2 is not covered by covering 60. In the embodiment shown in FIG. 6, a portion of the bottom surface 2, the middle section of the bottom surface 2, is not covered by covering 60.

The rustication form of the present invention, having only portions of the unexposed surfaces covered while covering all of the exposed surfaces, allows for easily attaching the rustication form to concrete forming slab or to the retaining walls. Generally, as discussed, rustication forms may be affixed or attached to the slab forming surface using adhesives or other attachment methods as known in the art. For example, glue and double sided tape are preferably used and nails are not as preferred since the slab forming surface is hard concrete. Also, because the covering is preferably smooth, tape and glue does not stick well to such smooth surfaces. Thus, a portion of the bottom surface 2 (surface not facing the curing concrete) is intentionally left uncovered to allow for adhesives to better adhere to the substrate of the rustication form.

Referring back to FIG. 3 for example, portions of the side unexposed surface 22 and the bottom unexposed surface 20 are also not covered by covering (not shown) so that adhesives can be used to affix the rustication form to a concrete forming surface or to a retainer wall. The edges where the unexposed surfaces 22 and 20 and diagonal exposed surface 24 meet are covered. And portion of the unexposed surfaces 22 and 20 near these edges are also covered.

Referring to FIG. 6 again, an additional benefit of continuously covering the exposed surfaces 4, 6 and 8 while covering only portions of the bottom surface 8 near the bottom edges 56 and 54, is that, the concrete weighs down on the rustication form especially around the partial covering at the bottom edges 54 and 56, to further prevent water seepage from reaching the bottom surface. If coverage stops at the bottom of the side surfaces 4 and 6, some water may seep in through to the uncovered bottom surface, causing the rustication form substrate to take on water, becoming bloated, enlarged, brittle, etc.

By having the bottom edges 54 and 56 covered, water is prevented from entering into the substrate. As concrete weighs down on the rustication form, the weight presses down on the bottom edges 54 and 56 of the rustication form—trapping the covering 60 over the bottom edges 54 and 56—to form a better seal against water seepage. Since the portions of the bottom surface 2 near the bottom edges 54 and 56 have the added laying of the covering 60, the middle portion of the bottom surface 2 may slightly elevated from the forming surface. As the weight of the curing concrete presses down, a seal is formed by the covering 60 near the bottom edges 54 and 56, which sandwiches the covering 60 at these areas, creating a tighter water seal and further preventing water from seeping into the rustication form substrate.

In another embodiment of the present invention, only sides with rough edges are covered entirely by the covering. Generally, in such embodiment, angled surfaces are covered. More specifically, outer surfaces that have rough or uneven surfaces are covered in their entirety.

Generally, when rustication substrates are cut from starting material, they are cut at an angle. For example, the example seen in FIG. 1 may be cut for example from plywood. Plywood generally possesses smooth outer surfaces. In FIG. 1, the top surface 8 and bottom surface 2 would be such smooth outer surfaces. In between the top surface 8 and bottom surface 2, the plywood would be comprised of multiple layers of thinner wood layers. When the rustication substrate is cut from such starting material, the top surface 8 and the bottom surface 2 would retain their smooth surface. The side surfaces 4 and 6, however, would instead have rough edges caused by the cutting process as well as the make up of the layering as described. Such rough surfaces formed at angles are more likely to take in water, and such rough surfaces also do not present an even surface for concrete imprinting. Even in other examples, such as with particle boards and foam starting materials, angled cut surfaces are generally more rough and uneven. Thus, the present invention contemplates covering the angled or cut surfaces having rough surfaces as compared to the smoother surfaces. Such cut surfaces are generally not as smooth as the original smooth outer surfaces. Thus, in alternative embodiments, these cut walls are preferably covered using a wrapper to provide a smoother, even surface.

Figure 7:
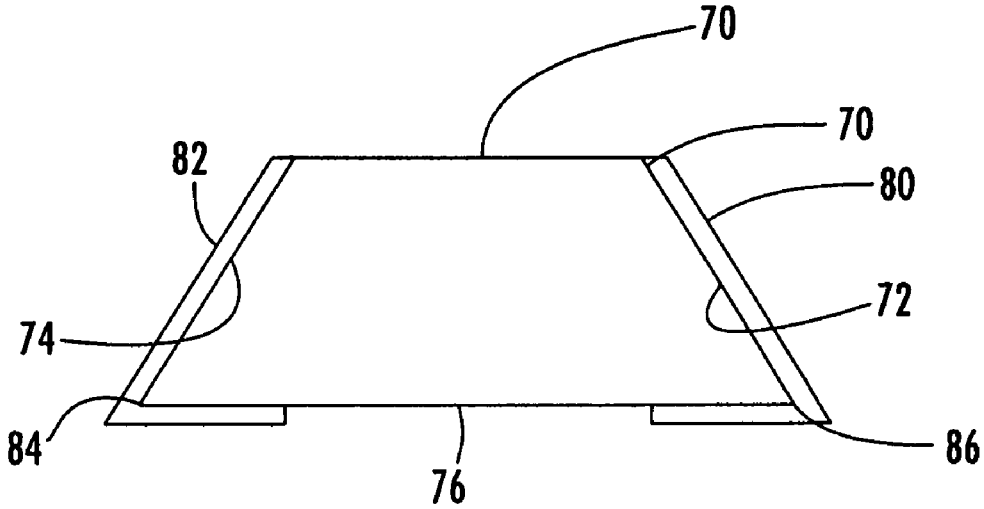
FIG. 7 shows a cross sectional view of a rustication substrate having four sides with covering over all of two side surfaces and over portions of the bottom surface.
Figure 8:
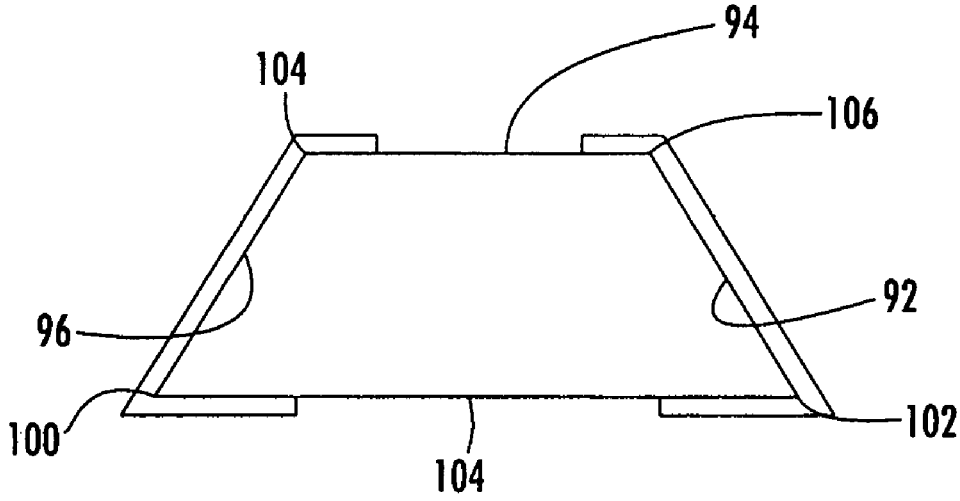
FIG. 8 shows a cross sectional view of a rustication substrate having four sides with covering over all of the two side surfaces and over portions of the bottom surface and over portion of the top surface.

As shown in FIGS. 7 and 8, the entire angled surfaces are covered. However, none or only portions of the flat original surfaces are covered. In FIG. 7, none of the top surface 70 is covered. The top surface 70 may generally be smooth and not cause problems in curing concrete. There are two coverings 80 and 82 covering the side surfaces 72 and 74 and the bottom edges 84 and 86 and portions of the bottom surface 76 near the bottom edges 84 and 86.

In FIG. 8, portions of the top surface 94 near the top edges 104 and 106 are covered continuously with the side surfaces 92 and 96. The coverings 92 and 96 also continuously cover around the bottom edges 100 and 102 and cover portions near the bottom edges 100 and 102 on the bottom surface 104. The partial covering of the bottom surface 104 allows for adhesives to be used on the uncovered bottom surface 104. The partial covering of the top surface 94 allows for the top edges 104 and 106 to be covered as well as in saving the costs by using less covering.

Figure 9:
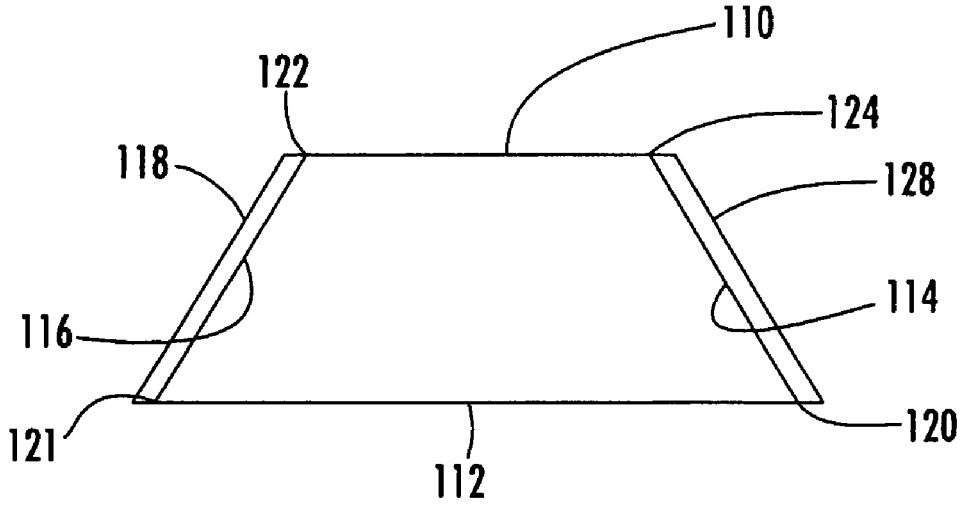
FIG. 9 shows a cross sectional view of a rustication substrate having four sides with covering over only the side surfaces.

In an alternative embodiment as seen in FIG. 9, only the side surfaces 114 and 116 are covered by coverings 118 and 128. No portion of top surface 110 and bottom surface 112 are covered. The top edges 122 and 124 and the bottom edges 121 and 120 are not covered in their entirety. In this embodiment, the most problematic surfaces, the side surfaces 116 and 114 having the rough surfaces have been covered.

Only partially covering certain surfaces, whether exposed to the concrete or not, is further advantageous in that such embodiments further save on costs associated with covering. Additional advantages are that the covering can be made of inexpensive material, for example from recycled or scrapped paper. Because of the low cost of the covering as well as the material used for the substrate, inexpensive one-time use disposable rustication forms can be used.

The present invention is preferably environmentally friendly, in that there is no need for harmful spraying or painting and that preferably it is made of biodegradable material.

The present invention also contemplates a method of forming architectural moldings or rustications in concrete slab walls comprising, placing rustication form of the present invention on a slab forming surface, wherein the substrate of the rustication form may be porous or semi-porous or have sides that are porous or rough, wherein said substrate, which has one or more surfaces exposed to curing concrete while having one or more surfaces not exposed to curing concrete, wherein wrapping or covering covers all of the surfaces exposed to curing concrete and only portions outer edges of the surfaces not exposed to curing concrete, wherein said wrapping or covering is a continuous sheet, wherein a portion of surface not exposed to curing concrete is not covered with said wrapping or covering to allow for use of adhesive.

Optionally, wherein only the rough surfaces of said substrate exposed to curing concrete is covered along with portions of surfaces not exposed to curing concrete. According to the method of the present invention, said rustication form is held in place on slab forming surface by affixing said rustication form to said slab forming surfacing. The concrete is then poured over said rustication form within retaining walls for forming said concrete slab. Once the concrete has been allowed to cure, the concrete slab wall is tilted up.

I claim:

1. A rustication form for creating architectural moldings or rustications comprising:

a solid and rigid rustication form substrate having multiple surfaces;

wherein said rustication form substrate further comprises one or more surfaces substantially exposed to poured concrete and one or more surfaces not substantially exposed to poured concrete;

said rustication form substrate covered by one or more covering;

wherein said covering covers all of said one or more surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more retaining walls.

2. A rustication form for creating architectural moldings or rustications comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more retaining walls.

3. A rustication form for creating architectural moldings or rustications comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said covering further covers one or more edges wherein one or more rough surfaces substantially exposed to poured concrete meet one or more smooth surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more retaining walls.

4. A rustication form for creating architectural moldings or rustications comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said one or more surfaces substantially not exposed to poured concrete further comprises one or more surfaces not covered by said covering;

and wherein said one or more surfaces substantially not exposed to poured concrete and not covered with covering provide one or more surfaces for adhesives to attach said rustication form to a concrete formation surface or one or more retaining walls.

5. A rustication form for creating architectural moldings or rustications according to claims 1, 2, 3 or 4, wherein said rustication form substrate is water absorptive.

6. A rustication form for creating architectural moldings or rustications according to claims 1, 2, 3 or 4, wherein said covering is water absorptive.

7. A rustication form for creating architectural moldings or rustications according to claims 1, 2, 3 or 4, wherein material from said covering is selected from a group consisting of paper-backed material, coated paper material, plastic material, and vinyl material.

8. A rustication form for creating architectural moldings or rustications according to claims 1, 2, 3 or 4, wherein said covering comprises a continuous and smooth surface that maintains its structural integrity when in contact with wet concrete during concrete curing.

9. A system for manufacturing rustication impressions on concrete structure comprising:

one or more curing surfaces;

a rustication form placed against said one or more curing surfaces comprising:

a solid and rigid rustication form substrate having multiple surfaces;

wherein said rustication form substrate further comprises one or more surfaces substantially exposed to poured concrete and one or more surfaces not substantially exposed to poured concrete;

said rustication form substrate covered by one or more covering;

wherein said covering covers all of said one or more surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more form walls; and concrete poured against said rustication form.

10. A system for manufacturing rustication impressions on concrete structure comprising:

one or more curing surfaces;

a rustication form placed on top of said curing surface comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more form walls; and concrete poured against said rustication form.

11. A system for manufacturing rustication impressions on concrete structure comprising:

one or more curing surfaces;

a rustication form placed on top of said curing surface comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said covering covers one or more portions of said one or more surfaces substantially not exposed to poured concrete along one or more edges formed by said one or more surfaces substantially not exposed to poured concrete meeting said one or more surfaces substantially exposed to poured concrete;

wherein said covering further covers one or more edges wherein one or more rough surfaces substantially exposed to poured concrete meet one or more smooth surfaces substantially exposed to poured concrete;

wherein said one or more surfaces substantially not exposed to poured concrete further comprises one or more surfaces not covered by said covering; and wherein said one or more surfaces substantially not exposed to poured concrete and not covered with covering provide one or more surfaces for adhesives to attach said rustication form to a concrete formation surface or one or more form walls; and concrete poured against said rustication form.

12. A system for manufacturing rustication impressions on concrete structure comprising:

one or more curing surfaces;

a rustication form placed on top of said curing surface comprising:

a solid and rigid rustication form substrate having multiple surfaces;

wherein said rustication form substrate further comprises one or more surfaces substantially exposed to poured concrete and one or more surfaces not substantially exposed to poured concrete;

wherein said one or more surfaces substantially exposed to poured concrete further comprises one or more smooth surfaces and one or more rough surfaces;

said rustication form substrate covered by one or more covering;

wherein said one or more covering covers one or more rough surfaces substantially exposed to poured concrete;

wherein said one or more surfaces substantially not exposed to poured concrete further comprises one or more surfaces not covered by said covering;

and wherein said one or more surfaces substantially not exposed to poured concrete and not covered with covering provide one or more surfaces for adhesives to attach said rustication form to a concrete formation surface or one or more form walls; and concrete poured against top said rustication form.

13. A system for manufacturing rustication impressions on concrete structure according to claims 9, 10, 11, or 12, wherein said rustication form substrate is water absorptive.

14. A system for manufacturing rustication impressions on concrete structure according to claims 9, 10, 11, or 12, wherein said covering is water absorptive.

15. A system for manufacturing rustication impressions on concrete structure according to claims 9, 10, 11, or 12, wherein material from said covering is selected from a group consisting of paper-backed material, coated paper material, plastic material, and vinyl material.

16. A system for manufacturing rustication impressions on concrete structure according to claims 9, 10, 11, or 12, wherein said covering comprises a continuous and smooth surface that maintains its structural integrity when in contact with concrete during initial concrete curing.

* * * * *